US007360961B1

(12) United States Patent
Deane et al.

(10) Patent No.: US 7,360,961 B1
(45) Date of Patent: Apr. 22, 2008

(54) TOOTHBRUSH

(76) Inventors: Christopher Deane, 7564-17 St. N., St. Petersburg, FL (US) 33702; Shauna R. Thornton, 7564-17 St. North, St. Petersburg, FL (US) 33702

( * ) Notice: Subject to any disclaimer, the term of this patent is extended or adjusted under 35 U.S.C. 154(b) by 0 days.

(21) Appl. No.: 11/473,557

(22) Filed: Jun. 23, 2006

Related U.S. Application Data

(66) Substitute for application No. 60/693,618, filed on Jun. 24, 2005.

(51) Int. Cl.
*A46B 11/02* (2006.01)
*A46B 11/04* (2006.01)

(52) U.S. Cl. ..... 401/188 R; 401/270

(58) Field of Classification Search ..... 401/188 R, 401/268, 270, 272, 273, 278, 282
See application file for complete search history.

(56) References Cited

U.S. PATENT DOCUMENTS 3,256,894 A * 6/1966 Sherman ..... 401/176
5,393,153 A * 2/1995 Bouthillier et al. ..... 401/146

* cited by examiner

*Primary Examiner*—David J. Walczak
(74) *Attorney, Agent, or Firm*—Kenneth L Tolar

(57) ABSTRACT

A toothbrush includes a housing having an internally threaded lower end with an air pump positioned therein. Extending from an upper end of the housing is an elongated neck having a toothbrush head at its distal end. A reciprocal button on the housing exterior operates the internal air pump. Any one of a plurality of externally threaded toothpaste cartridges may be secured to the internally threaded lower end of the housing. Toothpaste is automatically dispensed to the brush head by reciprocating the button.

3 Claims, 1 Drawing Sheet

TOOTHBRUSH

CROSS REFERENCE TO RELATED APPLICATIONS

This application is entitled to the benefit of provisional application No. 60/693,618 filed on Jun. 24, 2005, the specification of which is incorporated herein by reference.

BACKGROUND OF THE INVENTION

The present invention relates to a toothbrush with interchangeably attachable, disposable toothpaste cartridges to combine the features of both a toothpaste dispenser and toothbrush.

DESCRIPTION OF THE PRIOR ART

When traveling, one must transport both a toothbrush and toothpaste, which is inconvenient. The present invention provides a combination toothbrush and toothpaste dispenser thereby eliminating the burden associated with transporting both products separately.

SUMMARY OF THE INVENTION

The present invention relates to a toothbrush including a housing having an internally threaded lower end with an air pump positioned therein. Extending from an upper end of the housing is an elongated neck having a toothbrush head at a distal end thereof. A reciprocal button on the housing exterior operates the internal air pump. Any one of a plurality of externally threaded toothpaste cartridges may be secured to the internally threaded lower end of the housing. Toothpaste is automatically dispensed to the brush head by reciprocating the button.

It is therefore an object of the present invention to provide a toothbrush that eliminates the need to separately transport both a toothbrush and toothpaste.

It is another object of the present invention to provide a toothbrush that combines a toothpaste dispenser and toothbrush.

Other objects, features, and advantages of the present invention will become readily apparent from the following detailed description of the preferred embodiment when considered with the attached drawings and the appended claims.

DESCRIPTION OF THE PREFERRED EMBODIMENT

Figure 1:
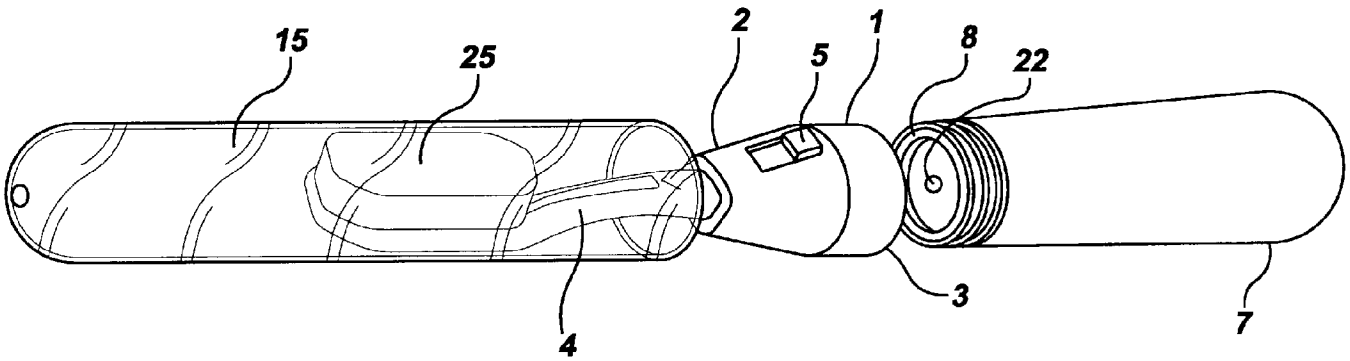
FIG. 1 is a perspective view of the toothbrush according to the present invention.
Figure 2:
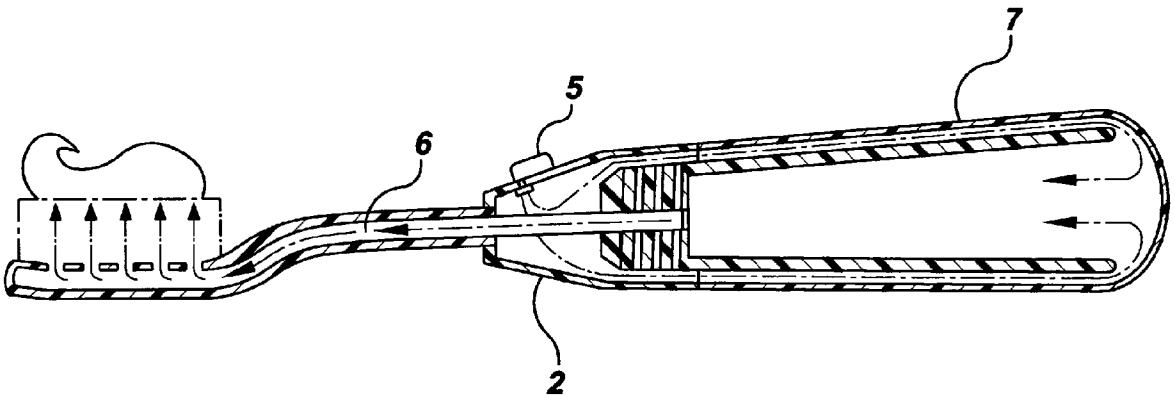
FIG. 2 is a side, cross-sectional view of the toothbrush according to the present invention.

The present invention relates to a toothbrush with an integral toothpaste dispenser comprising a housing 1 having an upper end 2 and an internally threaded lower end 3.

Extending from the upper end of the housing is an elongated neck 4 having a toothbrush head 25 at a distal end thereof. Positioned on the housing exterior is a reciprocal button 5 that operates an internal air pump. A fluid passageway 6 extends from the lower end of the housing to the brush head.

The device also includes a plurality of disposable cartridges 7 each having toothpaste received therein. Each cartridge includes an externally threaded upper end 8 that is adapted to couple with the lower end of the housing. Preferably each cartridge includes a discharge opening 22 at the upper end that is positioned to align with an inlet of the fluid passageway when the cartridge is properly secured to the housing. An elongated tubular cover 15 protects the brush head when not in use.

Accordingly, a user secures a desired cartridge to the housing and reciprocates the button thereby pressurizing the cartridge interior chamber; toothpaste is therefore automatically delivered to the brush head via the passageway.

The above described device is not limited to the exact details of construction and enumeration of parts provided herein. Furthermore, the size, shape and materials of construction of the various components can be varied.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A toothbrush with an integral toothpaste dispenser comprising:

a housing having an upper end and an internally threaded lower end;

an elongated neck extending from the upper end of the housing, said neck having a toothbrush head at a distal end thereof;

an air pump within said housing;

a reciprocal button positioned on the housing intermediate the elongated neck and the threaded lower end that operates said air pump;

a fluid passageway extending from the lower end of the housing to the brush head;

a plurality of interchangeable, disposable cartridges, each of said cartridges having an interior chamber with toothpaste received therein, each cartridge including an externally threaded upper end for coupling with the internally threaded lower end of the housing whereby reciprocation of said button pressurizes said interior chamber to force toothpaste through said passageway and onto said brush head.

2. The toothbrush according to claim 1 wherein each cartridge includes a discharge opening at an upper end that is positioned to align with an inlet of the fluid passageway when the cartridge is properly secured to the housing.

3. The toothbrush according to claim 2 further comprising an elongated tubular cover that is securable to the upper end of the housing to protect the brush head when not in use.

* * * * *